United States Patent [19]

Cowan

[11] Patent Number: 4,903,758

[45] Date of Patent: Feb. 27, 1990

[54] PLATE HEAT TRANSFER APPARATUS WITH LEAKAGE DETECTOR

[75] Inventor: Colin T. Cowan, Dormans Park, near East Grinstead, Great Britain

[73] Assignee: Baker Perkins plc, Peterborough, United Kingdom

[21] Appl. No.: 229,177

[22] Filed: Aug. 5, 1988

[30] Foreign Application Priority Data

Aug. 7, 1987 [GB] United Kingdom ..... 8718735

[51] Int. Cl.[4] ..... F28F 11/00; F28F 3/10

[52] U.S. Cl. ..... 165/11.1; 165/70; 165/167

[58] Field of Search ..... 165/11.1, 70, 166, 167; 73/40.5 R

[56] References Cited

U.S. PATENT DOCUMENTS

| | | | |
|---|---|---|---|
| 2,582,871 | 1/1952 | Kintner | 165/70 |
| 3,908,757 | 9/1975 | Wright | 165/167 |
| 4,372,375 | 2/1983 | Bond | 165/70 |
| 4,569,312 | 2/1986 | Riddell et al. | 165/70 |
| 4,800,007 | 1/1989 | Karlsson et al. | 165/166 |

FOREIGN PATENT DOCUMENTS

| | | | |
|---|---|---|---|
| 2725224 | 12/1978 | Fed. Rep. of Germany | 165/11.1 |
| 1455415 | 11/1976 | United Kingdom | 165/11.1 |
| 1500917 | 2/1978 | United Kingdom . | |

*Primary Examiner*—John Ford

*Attorney, Agent, or Firm*—Hamilton, Brook, Smith & Reynolds

[57] ABSTRACT

A plate heat exchanger has a number of adjacent plates with vents arranged to vent material from transfer bridge zones to atmosphere. An electrode extending lengthwise of the apparatus and through apertures of the plates contacts the vented material when an unacceptable level of accumulation of vented material occurs in dead spaces adjacent the apertures. A detectable change of effective electrical capacitance or resistance caused by the accumulated material approaching or touching the electrode is used to generate a warning signal.

6 Claims, 2 Drawing Sheets

PLATE HEAT TRANSFER APPARATUS WITH LEAKAGE DETECTOR

BACKGROUND OF THE INVENTION

This invention relates to plate heat exchangers and plate evaporators, hereinafter referred to collectively as plate heat transfer apparatus.

In such heat transfer apparatus, heat is transferred between two thin, broad streams, which may be both of liquid or one stream of liquid and one stream of vapour or two streams of vapour. In some cases one or both streams may have mixed liquid and vapour phases. The streams are separated by plates assembled in a spaced face-to-face relationship to provide flow spaces between the adjacent faces of the plates. The boundaries of the flow spaces are enclosed and sealed by flexible or resilient gaskets surrounding the flow spaces between the adjacent faces, and disposed between the flow spaces and entry and exit ports. The ports, in plate heat exchangers usually one at each corner of the plate, are similarly surrounded or part-surrounded by gaskets as appropriate to control the flow to and from the flow spaces.

Each gasket is normally of a one piece construction set within a pressed recess formed in the plate. The manufacture of the gasket is normally carried out in moulds, but according to the size of the plate of the manufacturing techniques used, the gasket may be assembled from two or more smaller components. The gaskets are normally moulded of an elastomeric material.

The sealing force against the fluid pressure in the flow space is obtained by compression of the gaskets in a direction normal to the plate surface.

A conventional generally rectangular heat transfer plate with a port near each corner is normally regarded as having a main heat transfer zone covering a majority of the area of the plate. At each end, the plate has a distribution region, which is part of the heat transfer zone, over which the feed fluid is distributed from the port over the width of the plate, or is collected from the width of the plate and directed towards the port. In view of the different functions of the different areas of the plate, the arrangement of corrugations or other formations on them may be markedly different.

One port, a transfer port, at each end of the plate is isolated from the flow space by a length of gasketing surrounding the port, the port gasket. The other port at each end, the flow port, will be in communication with the heat transfer zone. Between each port and the distribution region is an area, the bridge zone, and normally the transfer bridge zones associated with the transfer ports are also isolated from the flow space by lengths of gasket, bridge gaskets. The transfer bridge zones are thus doubly isolated and normally can be used as vented leakage spaces. Depending on the orientation of the vents from the transfer bridge zones and the shape of the adjacent gasketing, it is possible that vented fluids can accumulate in dead spaces between the plates and not easily or naturally drain or move out of the dead spaces and away from the apparatus especially if the vents become blocked with debris or crystalline deposits.

SUMMARY OF THE INVENTION

According to the present invention, there is provided a plate heat transfer apparatus having vented leakage passages and a monitoring system for sensing any accumulation of materials adjacent the exits of the vents and for producing a signal whenever the accumulation reaches a predetermined magnitude.

The monitoring system may comprise a sensor electrode which extends at least substantially along the length of the plate heat transfer apparatus through an aperture provided in each plate adjacent respective vent exits.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views.

DETAILED DESCRIPTION OF THE INVENTION

Figure 1:
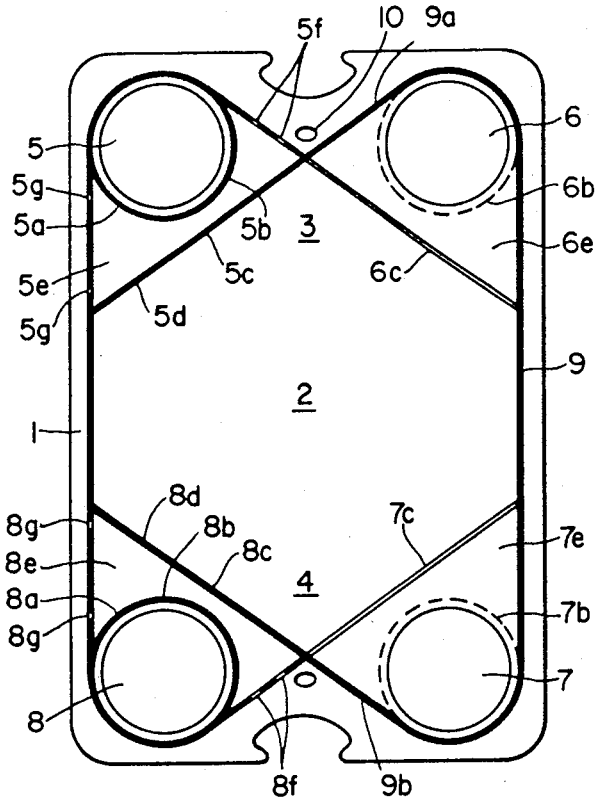
FIG. 1 is an elevation of a plate heat exchanger plate.

Referring first to FIG. 1, the plate 1 illustrated has a flow space zone, comprising a main heat exchange zone 2 and two distribution regions 3 and 4, and corner ports 5, 6, 7 and 8. A peripheral gasket 9 is mounted in a recess which runs along the sides of the plate 1 and round the outside of the ports. The ports 5 and 8 are transfer ports and isolated from the flow space zone by transfer port gaskets **5*a* and 8*a*, also mounted in recesses 5*b* and 8*b*, and the ungasketed port recesses associated with the flow ports 6 and 7 are shown at 6*b* and 7*b*. Each of the ports 5 to 8 has a bridge recess 5*c* to 8*c*, and the transfer bridge recesses 5*c* to 8*c* are occupied by transfer bridge gaskets 5*d* and 8*d*. The transfer bridge zones 5*e* and 8*e* associated with the transfer ports 5 and 8 are isolated by gaskets from both the respective transfer port and the flow space zone. The transfer bridge zones 5*e* and 8*e* are vented by vents 5*f*, 5*g* and 8*f*, 8*g* in the gasket 9. An aperture 10 is provided in the plate 1 adjacent the vents 5*f* and 8*f***.

In use when the plates are all held together any material vented from the transfer bridge zone **5*e* through the vents 5*f* can accumulate in a dead space bounded at its base by the V-form of the gasket 9 lying between the ports 5 and 6 and bounded at its sides by the surfaces of respective adjacent plates 1 especially if the vents 5*g* become partially or wholly blocked with debris. Similarly, should there be any leakage across the gasket in position 9A, liquid can accumulate in the V-form, especially if the vents 5*f* and/or 5*g*** become blocked.

Figure 2:
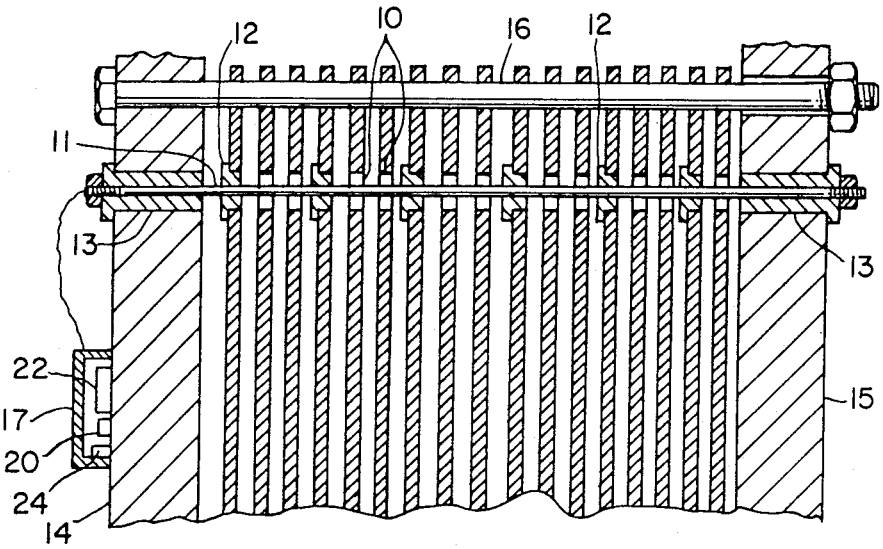
FIG. 2 is a side elevation of part of a plate heat exchanger apparatus embodying the present invention.
Figure 3:
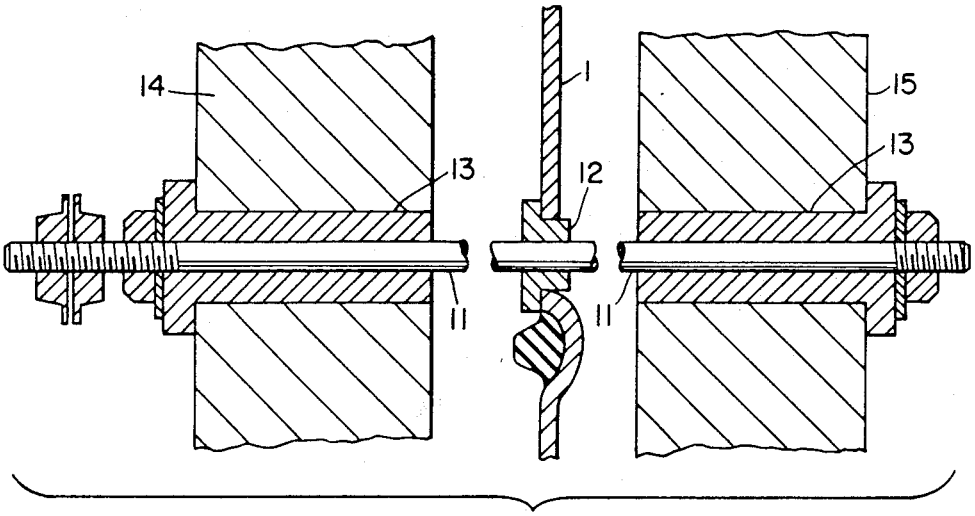
FIG. 3 is a more detailed side elevation of part of the apparatus of FIG. 2.

In FIGS. 2 and 3, the plates 1 are shown joined together with apertures 10 in line to receive an electrode 11. At some or all the apertures 10 the electrode 11 is supported out of electrical contact with the plates by insulating bushes 12. At each end of the electrode an insulating ferrule 13 is mounted in each frame 14 and 15. The end frames also carry a plate support beam 16 which keys into and supports each of the plates 1.

The electrode 11 is electrically coupled to a control circuit 22 in a panel 17 which can be fixed to the end frame 14. An alarm generator 20 is mounted in the panel 17 to provide a visible or audible alarm. In use if the electrode is contacted by liquid, the control circuit 22 responding to changes in effective capacitance or resistance between the electrode and the plates 1, initiates a warning signal which can be visible and/or audible and/or relayed as an electrical signal to a central industrial processing plant control room, for example, as desired. This means that if liquid accumulates to such magnitude that the electrical capacitance between the electrode and the plates or if it contacts the electrode in any of the dead spaces altering the electrical resistance between the electrodes to the plates, described in FIG. 1, an alarm signal is automatically produced.

The electrode 11 is normally at or very close to the lowest point of each of the dead-spaces so that an alarm is produced when only a small quantity of vented liquid has accumulated. However, the electrode can also, for other applications or situations be mounted further up in the dead spaces so as to produce a signal only when a substantial accumulation has occurred.

It is also possible to have a second, or third electrode at a point higher along the dead spaces so as to provide another warning signal when the accumulation has reached a second, or third, higher level.

The bushes 12 are made of thermo-setting or high temperature thermo plastics material. Suitable plastics material such as PTFE and rubber could also be used. Preferably, the material chosen has a low coefficient of friction so that the electrode 11 is more easily inserted into position after assembly of the plates 1 together in the apparatus without disturbing the insulating bushes.

The electrode 11 is preferably made of non-corrosive material both to extend its life and to prevent monitoring errors occurring due to corrosion affecting the effective capacitance or resistance of the electrode especially at the point of first contacting the accumulated liquids. Clearly however, the electrical circuit can include variable parameters so that corrosion related and environmental changes can be accommodated for and the circuit re-calibrated from time to time if required.

The panel 17 may incorporate a battery 24 so that the electrode 11 and control circuit 22 can be powered independently of a main supply.

It will be noted that accumulation in the dead spaces of small amounts of material which the plates 1 are designed to be chemically resistant to should not be expected to cause any problems. However, because the material may be unable to drain away or otherwise easily escape from the dead spaces it may remain there for some considerable period of time during which its chemical composition may change. For example, the vented material may become more concentrated due to evaporation or the vented material may become mixed with water condensing into the dead spaces or falling between the plates and flowing into the dead spaces from outside the apparatus. As such the increased concentration and/or mixing with water can change the chemical reactivity so that the plate material is attacked by the accumulated material in the dead space. Thus, we have found it to be important in many applications to have an automatic warning produced to provide an early indication of accumulating material in the dead spaces so that remedial action can be taken before any or significant corrosion takes place.

While the invention has been particularly shown and described with reference to a preferred embodiment thereof, it will be understood by those skilled in the art that various changes in form and details may be made therein without departing from the spirit and scope of the invention as defined by the appended claims.

I claim:

1. A plate heat transfer apparatus comprising:

a plurality of plates positioned relative to each other to form a stack, each plate having a peripheral gasket and having a transfer bridge zone at least partially surrounded by the peripheral gasket;

for each plate, vents through the peripheral gasket leading from the plate transfer bridge zone to dead spaces outside of the peripheral gasket between the plate and an adjacent plate; and a monitoring system for sensing accumulation of material in at least one of the dead spaces, said monitoring system arranged to produce a warning signal upon accumulation of a predetermined amount of material in dead spaces, the monitoring system comprising an electrode which passes through the dead spaces of the stack of plates and extends along the apparatus through apertures in the plates forming the apparatus.

2. An apparatus according to claim 1 wherein the electrode is supported by electrically insulating bushes mounted in at least one of the apertures.

3. An apparatus to claim 2 wherein the bushes are formed of low frictional coefficient material to facilitate entry of the electrode through the bushes after the apparatus has been assembled.

4. An apparatus according to claim 1 further comprising an electrical circuit electrically coupled to the electrode and mounted in a panel fixed to one end of the apparatus.

5. An apparatus according to claim 4 further comprising a battery to power the electric circuit and an alarm generator.

6. A plate heat transfer apparatus having a plurality of plates in a stack; vented leakage passages from transfer areas of the plates leading to dead spaces between the plates; and a monitoring system for sensing accumulation of material, in at least one of the dead spaces, arranged to produce a warning signal whenever accumulation therein reaches a predetermined magnitude, the monitoring system comprising an electrode which passes through the dead spaces and extends along the apparatus through apertures in the plates forming the apparatus.

* * * * *